US012274954B1

(12) United States Patent
Rogers et al.

(10) Patent No.: US 12,274,954 B1
(45) Date of Patent: Apr. 15, 2025

(54) BRACKET ASSEMBLY CONFIGURED TO SUPPORT GRID PANEL RELATIVE TO ORCHESTRA PIT FILLERS OR STAGE EXTENSIONS

(71) Applicant: STAGERIGHT CORPORATION, Clare, MI (US)

(72) Inventors: Grant Rogers, Sanford, MI (US); Ryan Johnson, Clare, MI (US)

(73) Assignee: STAGERIGHT CORPORATION, Clare, MI (US)

( * ) Notice: Subject to any disclaimer, the term of this patent is extended or adjusted under 35 U.S.C. 154(b) by 157 days.

(21) Appl. No.: 18/107,197

(22) Filed: Feb. 8, 2023

(51) Int. Cl.
*A63J 1/00* (2006.01)
*E04B 1/19* (2006.01)

(52) U.S. Cl.
CPC ..... *A63J 1/00* (2013.01); *E04B 1/1903* (2013.01); *E04B 2001/199* (2013.01)

(58) Field of Classification Search
CPC .... A63J 1/00; E04B 1/1903; E04B 2001/199; E04H 3/24
See application file for complete search history.

(56) References Cited

U.S. PATENT DOCUMENTS

| | | | | |
|---|---|---|---|---|
| 3,964,402 | A | 6/1976 | Jenne'et al. | |
| 5,848,501 | A | 12/1998 | Taipale et al. | |
| 6,581,339 | B2 | 6/2003 | Thiede | |
| 7,874,115 | B2 | 1/2011 | Thiede | |
| 9,631,385 | B1 * | 4/2017 | Phillips | E04C 2/44 |
| 10,221,581 | B2 | 3/2019 | Phillips | |
| 11,428,015 | B2 | 8/2022 | Huss et al. | |
| 2002/0116885 | A1 * | 8/2002 | Thiede | E04H 3/24 52/263 |
| 2004/0211137 | A1 * | 10/2004 | Thiede | E04B 5/02 52/272 |
| 2006/0185258 | A1 | 8/2006 | Ouellet et al. | |
| 2017/0226761 | A1 * | 8/2017 | Phillips | E04B 5/43 |
| 2022/0064965 | A1 * | 3/2022 | Huss | E04F 19/02 |
| 2022/0064975 | A1 | 3/2022 | Bechtol et al. | |
| 2024/0263471 | A1 * | 8/2024 | Rogers | E04H 3/24 |
| 2024/0263472 | A1 * | 8/2024 | Rogers | A63J 1/00 |

FOREIGN PATENT DOCUMENTS

| | | |
|---|---|---|
| CN | 110878651 A | 3/2020 |
| GB | 2456817 B | 3/2010 |

OTHER PUBLICATIONS

Orchestra pit filler projects. https://www.sightlinecommercial.com/application/orchestra-pit-filler/.
Strata® Orchestra pit filler. Wenger. (n.d.). Retrieved Feb. 8, 2023, from https://shop.wengercorp.com/education/stratar-orchestra-pit-filler.html.

* cited by examiner

*Primary Examiner* — Rodney Mintz
(74) *Attorney, Agent, or Firm* — Carlson, Gaskey & Olds, P.C.

(57) ABSTRACT

This disclosure relates to a bracket assembly configured to support a grid panel relative to an orchestra pit filler or a stage extension. Among other benefits, the bracket assembly provides a robust and easily-installed connection point for a grid panel. Further, the bracket assembly supports the grid panel beneath the deck panels of the orchestra pit filler, thereby improving aesthetics of the orchestra pit filler and the stage overall.

19 Claims, 6 Drawing Sheets

BRACKET ASSEMBLY CONFIGURED TO SUPPORT GRID PANEL RELATIVE TO ORCHESTRA PIT FILLERS OR STAGE EXTENSIONS

TECHNICAL FIELD

This disclosure relates to a bracket assembly configured to support a grid panel relative to an orchestra pit filler or a stage extension.

BACKGROUND

Theaters, including playhouses, opera houses, performing arts centers, and concert halls, typically include a stage for performers and a seating area for an audience. Some theaters also include an orchestra pit that is usually located in a lowered area between the stage and the seating area. In particular, the orchestra pit is typically immediately in front of the stage.

During stage performances that do not use an orchestra, the orchestra pit can be filled, either partially or fully. The orchestra pit may be filled using a system, referred to as an orchestra pit filler, that includes a frame assembly and a plurality of panels, which may be referred to as deck panels or simply decks. The panels are supported above the lowered area of the orchestra pit by the frame assembly. Stage extensions are systems, similar to orchestra pit fillers, that include a frame assembly supporting a plurality of panels in front of a stage.

Both orchestra pit fillers and stage extensions can be configured such that the deck panels are substantially aligned with the stage, such that the deck panels essentially increase the effective surface area of the stage, which allows stage performers to be closer to the seating area.

SUMMARY

In some aspects, the techniques described herein relate to a system for at least partially filling an orchestra pit or extending a stage, including: a frame assembly including a beam; a grid panel; and a bracket assembly connected to the beam and configured to support the grid panel, wherein the bracket assembly is configured to hold the grid panel in a position in which a top of the grid panel is substantially vertically aligned with a top of the beam.

In some aspects, the techniques described herein relate to a system, wherein: the grid panel includes an outer frame and a plurality of cables connected to the outer frame, and the bracket assembly includes an arm defining a slot configured to receive a portion of the outer frame.

In some aspects, the techniques described herein relate to a system, wherein the arm includes a horizontal section and a vertical section projecting vertically from an end of the horizontal section.

In some aspects, the techniques described herein relate to a system, wherein the horizontal section is substantially perpendicular to the vertical section.

In some aspects, the techniques described herein relate to a system, wherein a fastener assembly is configured to connect the outer frame to the vertical section.

In some aspects, the techniques described herein relate to a system, wherein: the bracket assembly includes a plate, and the horizontal section projects from the plate.

In some aspects, the techniques described herein relate to a system, wherein: the arm includes a brace projecting from the plate, and a top of the brace is connected to a bottom of the horizontal section.

In some aspects, the techniques described herein relate to a system, wherein the brace is substantially triangular in shape.

In some aspects, the techniques described herein relate to a system, wherein: the beam includes a slotted channel, and a fastener assembly connects the bracket assembly to the beam via the slotted channel.

In some aspects, the techniques described herein relate to a system, wherein: a nut is arranged in the slotted channel, and a bolt extending through the plate engages the nut to connect the bracket assembly to the beam.

In some aspects, the techniques described herein relate to a system, wherein the plate includes a locating tab projecting from the plate adjacent a top of the slotted channel.

In some aspects, the techniques described herein relate to a system, wherein: the beam includes a capture channel open facing toward the slotted channel, and an upper edge of the plate is received in the capture channel.

In some aspects, the techniques described herein relate to a system, wherein: the beam includes a deck attachment channel arranged vertically above the capture channel, the deck attachment channel includes a slot open facing a direction opposite the capture channel, and a deck panel is connectable to the beam via the deck attachment channel using a fastener assembly.

In some aspects, the techniques described herein relate to a system, wherein: a deck panel is connected to the beam, and the bracket assembly is configured to support the grid panel in a position in which a top of the grid panel is vertically spaced-apart beneath a top of the deck panel.

In some aspects, the techniques described herein relate to a system, wherein the bracket assembly is configured to support the grid panel in a position in which a top of the grid panel is vertically aligned with a bottom of the deck panel.

In some aspects, the techniques described herein relate to a system, wherein the deck panel vertically overlaps the bracket assembly, and the bracket assembly is configured such that neither the grid panel nor the bracket assembly interferes with a connection of the deck panel to the beam.

In some aspects, the techniques described herein relate to a method of at least partially filling an orchestra pit or extending a stage, including: supporting a grid panel using a bracket assembly connected to a beam such that the grid panel is held in a position in which a top of the grid panel is substantially aligned with a top of the beam.

In some aspects, the techniques described herein relate to a method, further including: positioning the bracket assembly along a length of the beam by sliding the bracket assembly relative to a slotted channel of the beam.

In some aspects, the techniques described herein relate to a method, further including: supporting a deck panel using the beam such the deck panel vertically overlaps the bracket assembly and such that neither the bracket assembly nor the grid panel interferes with a connection of the deck panel to the beam.

In some aspects, the techniques described herein relate to a method, further including: supporting a deck panel using the beam, wherein the deck panel is supported by an opposite side of the beam as the grid panel, and wherein the bracket assembly supports the grid panel in a position in which a top of the grid panel is vertically spaced-apart beneath a top of the deck panel.

DETAILED DESCRIPTION

This disclosure relates to a bracket assembly configured to support a grid panel relative to an orchestra pit filler or a stage extension. Among other benefits, the bracket assembly provides a robust and easily-installed connection point for a grid panel. Further, the bracket assembly supports the grid panel beneath the deck panels of the orchestra pit filler, thereby improving aesthetics of the orchestra pit filler and the stage overall.

Figure 1:
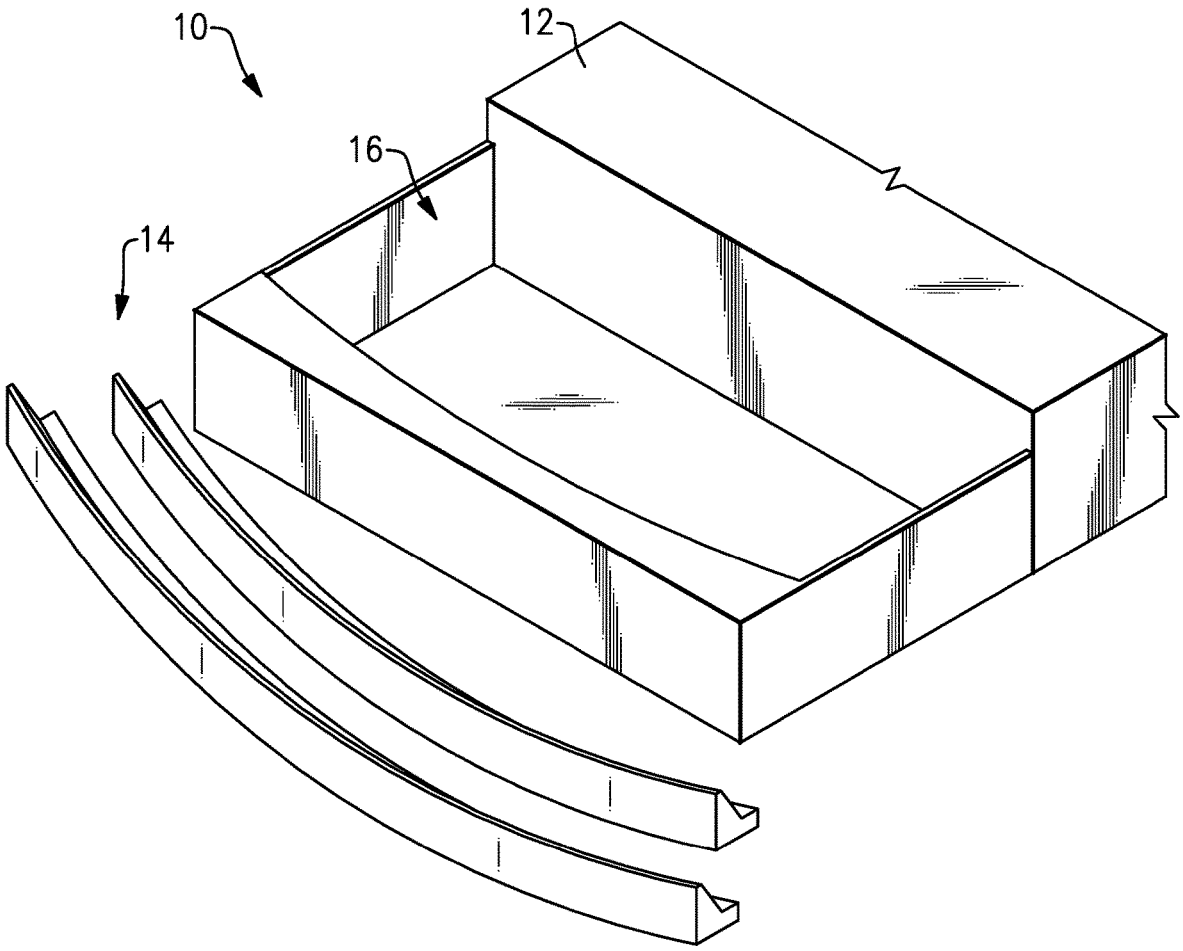
FIG. 1 is a perspective view of a portion of a theatre, including an orchestra pit.

FIG. 1 illustrates a portion of a theatre 10 from a perspective of an audience. The theatre 10 includes a stage 12, a seating area 14, and an orchestra pit 16. The orchestra pit 16 is a lowered area between the stage 12 and the seating area 14. In this example, the orchestra pit 16 is immediately in front of the stage 12.

This disclosure is not limited to any particular type of theatre 10. To this end, the term theatre is used broadly in this disclosure to refer to any venue with a stage and a seating area, including playhouses, opera houses, performing arts centers, concert halls, auditoriums, etc. The term theatre is inclusive of venues with stages that are fixed or portable, and is further inclusive of venues with seating areas that have fixed, retractable, or portable seats.

This disclosure is not limited to venues with an orchestra pit. To this end, while orchestra pit fillers are mentioned herein, this disclosure extends to stage extensions.

Figure 2:
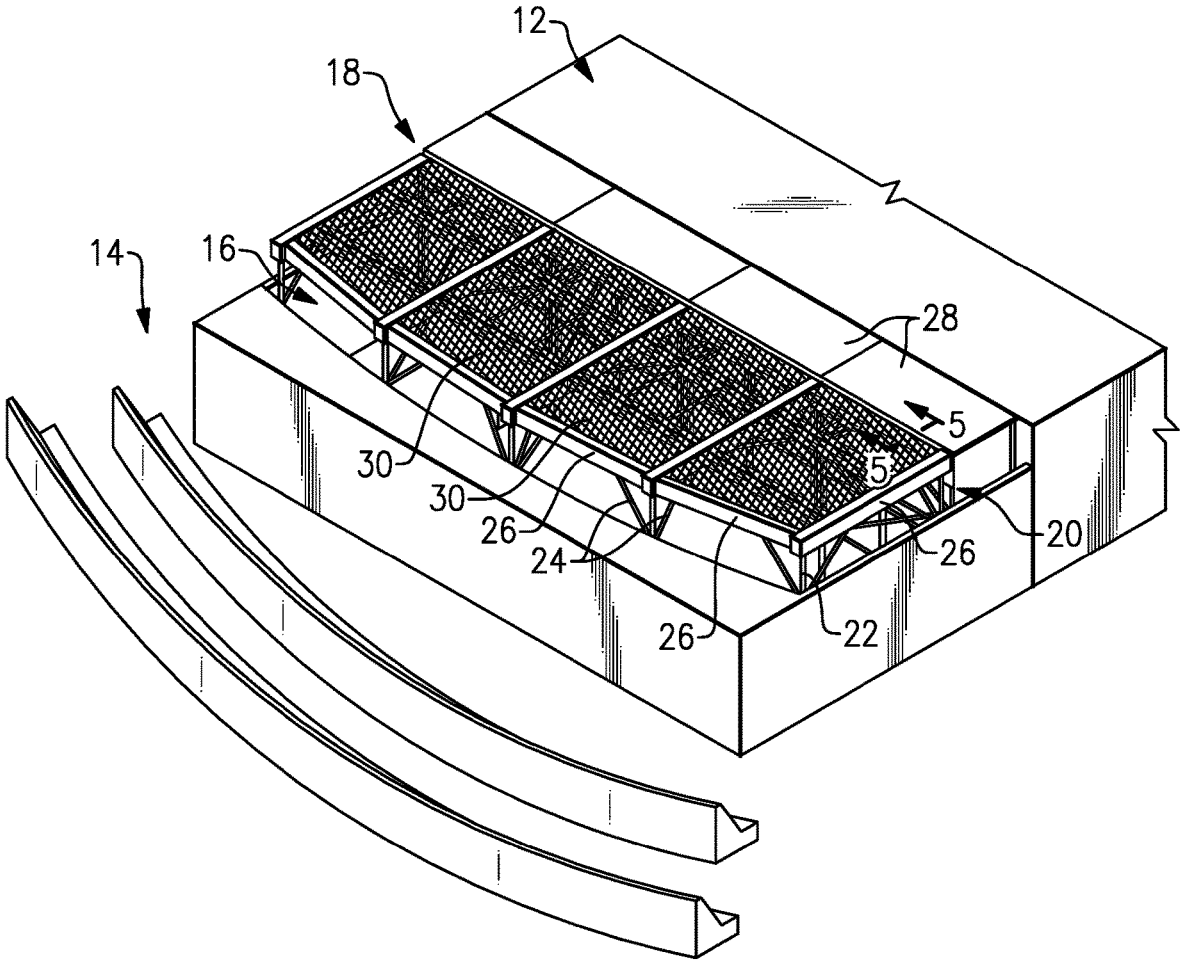
FIG. 2 is a similar view to FIG. 1, but illustrates an orchestra pit filler in the orchestra pit.

FIG. 2 illustrates the same portion of the theatre 10 of FIG. 1, but with an orchestra pit filler 18 arranged in the orchestra pit 16. In this example, the orchestra pit filler 18 includes a frame assembly 20 including a plurality of vertically-extending legs 22, braces 24, and beams 26. The beams 26 are supported adjacent a top of the legs 22 and are configured to support deck panels 28 and/or grid panels 30. As shown in FIG. 2, the frame assembly 20 supports a plurality (specifically, four) deck panels 28 such that the deck panels 28 abut a front edge of the stage 12 and such that a top of the deck panels 28 is substantially vertically aligned with a top of a front portion of the stage 12. In this way, the deck panels 28 are readily accessed from the stage 12, and performers and/or set pieces can be supported by the deck panels 28, which effectively increases the surface area of the stage 12.

In this example, the deck panels 28, which may be referred to simply as decks, are substantially solid and may be made primarily of a wood or composite material, for example. The orchestra pit filler 18 also includes a plurality of grid panels 30 supported by the frame assembly 20.

Figure 3:
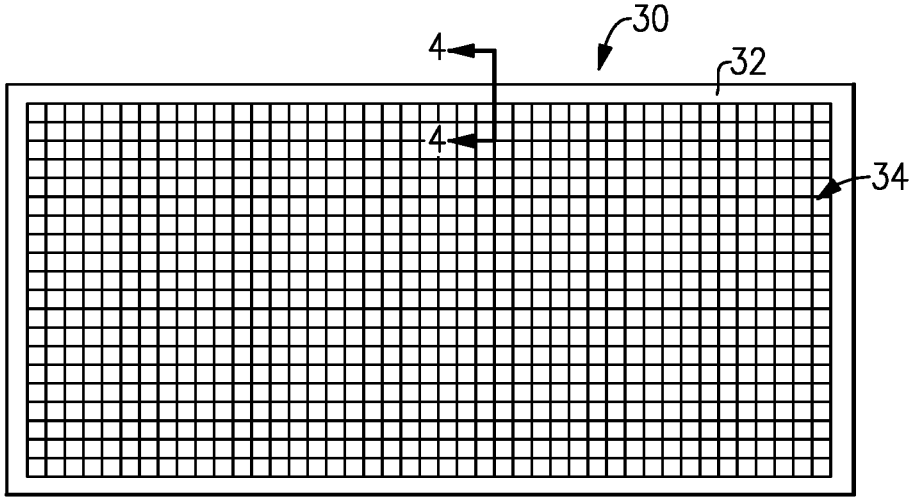
FIG. 3 is a top view of a grid panel.
Figure 4:
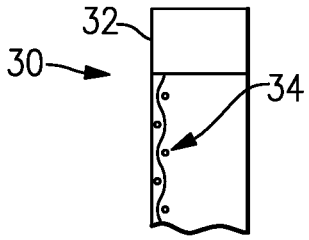
FIG. 4 is a partial cross-sectional view of the grid panel taken along line 4-4 in FIG. 3.

An example grid panel 30 is shown in FIGS. 3 and 4. In this example, the grid panel 30 is a tension grid panel including an outer frame 32 and interwoven wire cables 34. While a tension grid panel has been shown and described, this disclosure extends to other grid panels configured to support applied loads while permitting sound to readily travel through the panel, including grid panels formed of expanded metal, perforated metal, or another type of structural grid material.

The outer frame 30 extends about a perimeter of the grid panel 30. The outer frame 32 circumscribes an area, which is rectangular in this example. A plurality of interwoven wire cables 34 are provided in the area. The outer frame 32 and the wire cables 34 may be made of a metallic material. The wire cables 34 are arranged in a grid pattern and provide square-shaped openings therebetween. In an example, the wire cables 34 are spaced-apart by about 1.875 inches and provide the square-shaped openings with an area of about 3.75 square inches. The wire cables 34 may be 0.125 inches in diameter in an example.

The orchestra pit filler 18 may include a plurality of grid panels 30 for a number of reasons. As one example, the orchestra pit filler 18 may include a combination of deck panels 28 and grid panels 30 where there is a desire to increase the effective surface area of the stage 12, but not to a degree that the entire orchestra pit 16 is filled with deck panels 28. Alternatively or additionally, some musicians may be present in the orchestra pit 16, and there is a desire to permit sound to be transmitted in and out of the orchestra pit 16. The grid panels 30 permit significantly greater sound transmission than the deck panels 28. Further, the grid panels 30 are configured to resist applied loads, and thereby resist movement of objects into the orchestra pit 16 from above.

While grid panels have benefits, they are deemed unsightly by some. The present disclosure provides a robust connection point for a grid panel to a beam of a frame assembly, while increasing the aesthetic appearance of the orchestra pit filler or stage extension.

Figure 5:
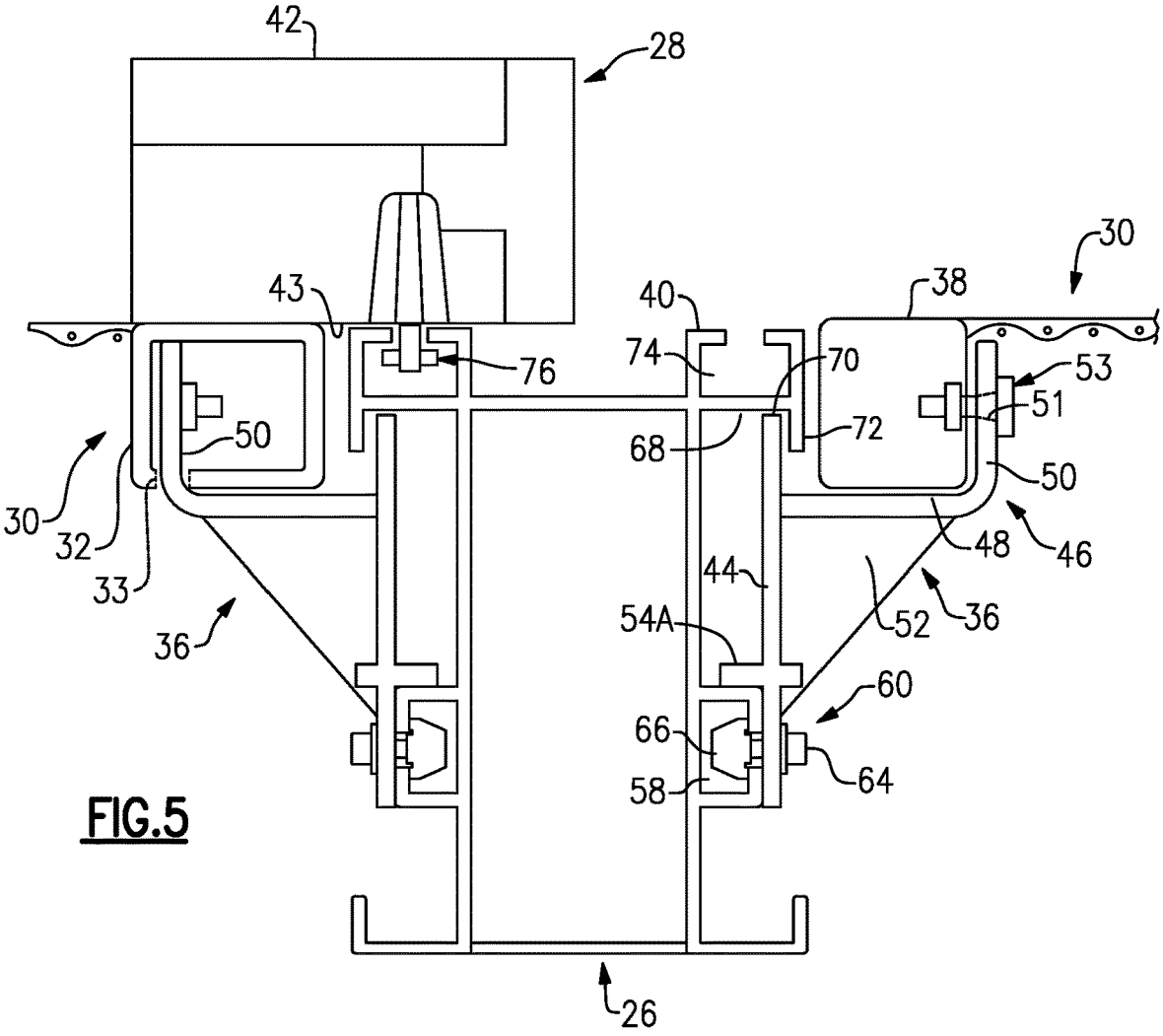
FIG. 5 is a cross-sectional view taken along line 5-5 and illustrates an example interface of a beam relative to two grid panels and a deck panel.

An aspect of this disclosure relates to a bracket assembly 36 configured to interface with a beam 26 and to support the grid panel 30 such that a top 38 of the grid panel 30 is substantially vertically aligned, or flush with, a top 40 of the beam 26, as generally shown in FIG. 5. Further, the bracket assembly 36 is configured to support the grid panel 30 such that the top 38 is vertically spaced-apart beneath a top 42 of the deck panels 28. In an example, the top 38 is vertically aligned with a bottom 43 of the deck panels 28.

Figure 7:
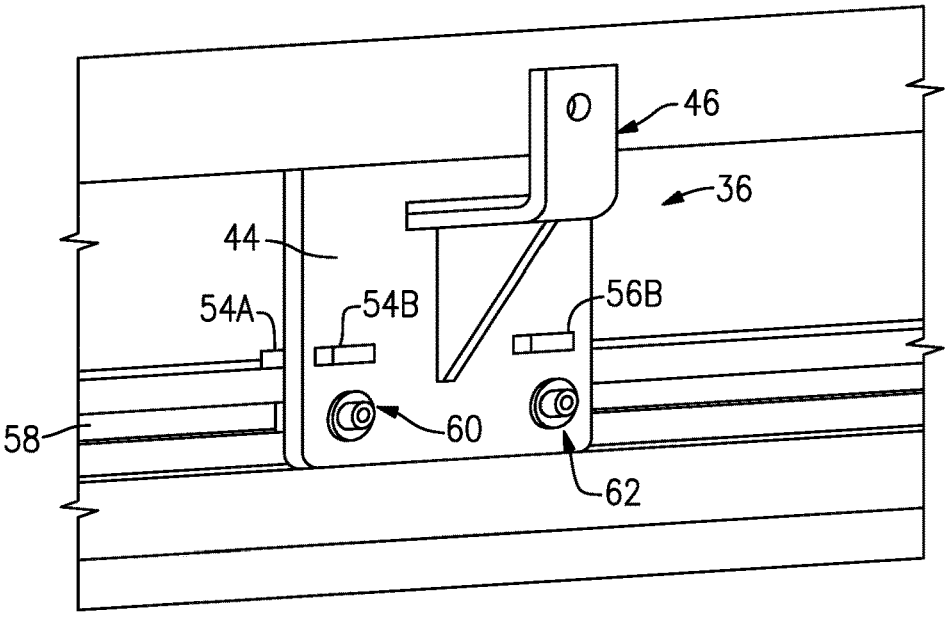
FIG. 7 is a perspective view illustrating an example interface of the bracket assembly relative to a side of a beam.
Figure 6:
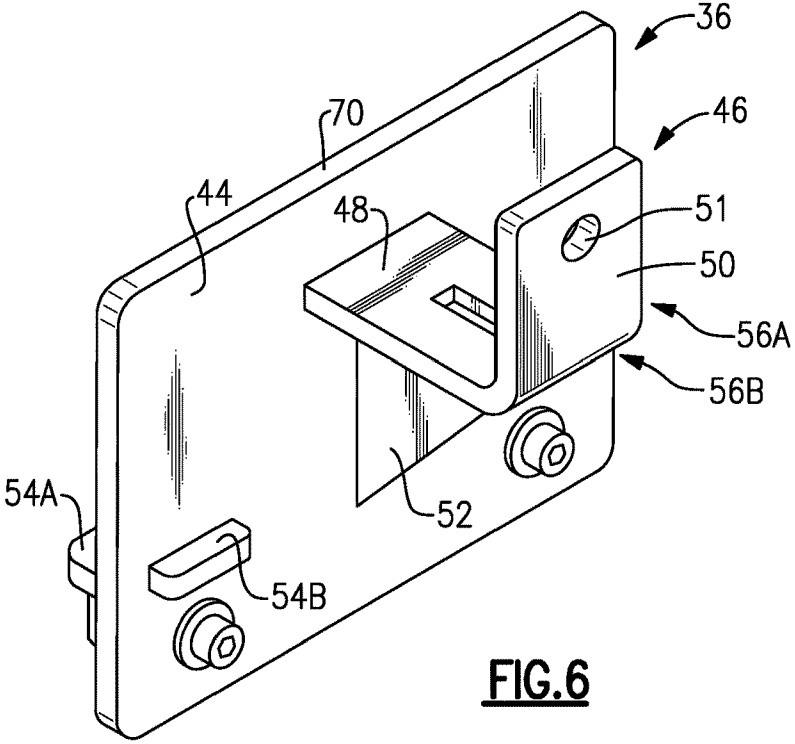
FIG. 6 is a perspective view of an example bracket assembly.

The bracket assembly 36 is shown in detail across FIGS. 5-7. With joint reference to those drawings, the bracket assembly 36 includes a plate 44 and an arm 46 projecting from a first side of the plate 44. The arm 46 defines a slot facing a vertically upward direction. The arm 46 includes a horizontal section 48 projecting from the plate 44 and a vertical section 50 projecting upward from the from the horizontal section 48. The horizontal section 48 is substantially perpendicular to the vertical section 50.

The horizontal and vertical sections 48, 50 are sized and shaped to fully receive the outer frame 32 of the grid panel 30, as shown in the right-hand side of FIG. 5. In an alternate example, as shown in the left-hand side of FIG. 5, the outer frame 32 can include a slot 33 configured to receive the vertical section 50, such that the slot defined by the horizontal and vertical sections 48, 50 partially receives the outer frame 32.

In an example, the vertical section 50 includes an opening 51 through which a fastener assembly 53 (FIG. 5), including a nut and bolt for example, can connect the vertical section 50 to the outer frame 32 of the grid panel 30.

Beneath the horizontal section 48, a brace 52 projects from the plate 44 and abuts a bottom surface of the horizontal section 48. The brace 52 is substantially triangular in shape.

On opposite sides of the arm 46, the plate 44 includes a first set of tabs 54A, 54B, and a second set of tabs 56A, 56B (tab 56A is not visible; tab 56B is visible in FIG. 7). Each set of tabs 54A, 54B, 56A, 56B includes a tab projecting from an opposite side of the plate 44. The tabs 54A, 56A are locating tabs configured to abut a top of a slotted channel 58 of the beam 26.

The bracket assembly 36 further includes first and second fastener assemblies 60, 62 arranged beneath respective first and second sets of tabs 54A, 54B, 56A, 56B. Together, the first and second fastener assemblies 60, 62 are configured to connect the bracket assembly 36 to the beam 26. The first and second fastener assemblies 60, 62 each include a bolt 64 and a nut 66. The nut 66 is arranged within the slotted channel 58, in this example. The first and second fastener assemblies 60, 62 can be loosened to permit the bracket assembly 36 to slide into position along the beam 26 relative to the slotted channel 58. The first and second fastener assemblies 60, 62 can be tightened to hold a position of the bracket assembly 36 relative to the beam 26.

Adjacent a top of the bracket assembly 36, the beam 26 includes a capture channel 68 configured to capture an upper edge 70 of the plate 44. The capture channel 68 is adjacent a top 40 of the beam 26 and is open facing toward the slotted channel 58, which is the vertical downward direction. A tab 72 defining a lateral boundary of the capture channel 68 projects vertically lower than the upper edge 70 of the plate 44 such that deflection of the upper edge 70 is resisted by the tab 72.

The beam 26 also includes a deck attachment channel 74 arranged vertically above the capture channel 68. The deck attachment channel includes a slot open facing a direction opposite the capture channel 68, which is vertically upward. A fastener assembly 76, which includes a nut in the deck attachment channel 74 and a bolt, is configured to connect a deck panel 28 to the beam 26.

Only one side of the beam 26 has been described. It should be understood that the beam 26 is symmetrical about its centerline in this example, as shown in FIG. 5. The beam 26 is able to connect to a deck panel 28 on one side and a grid panel 30 on an opposite side, as shown in FIG. 5.

Figure 8:
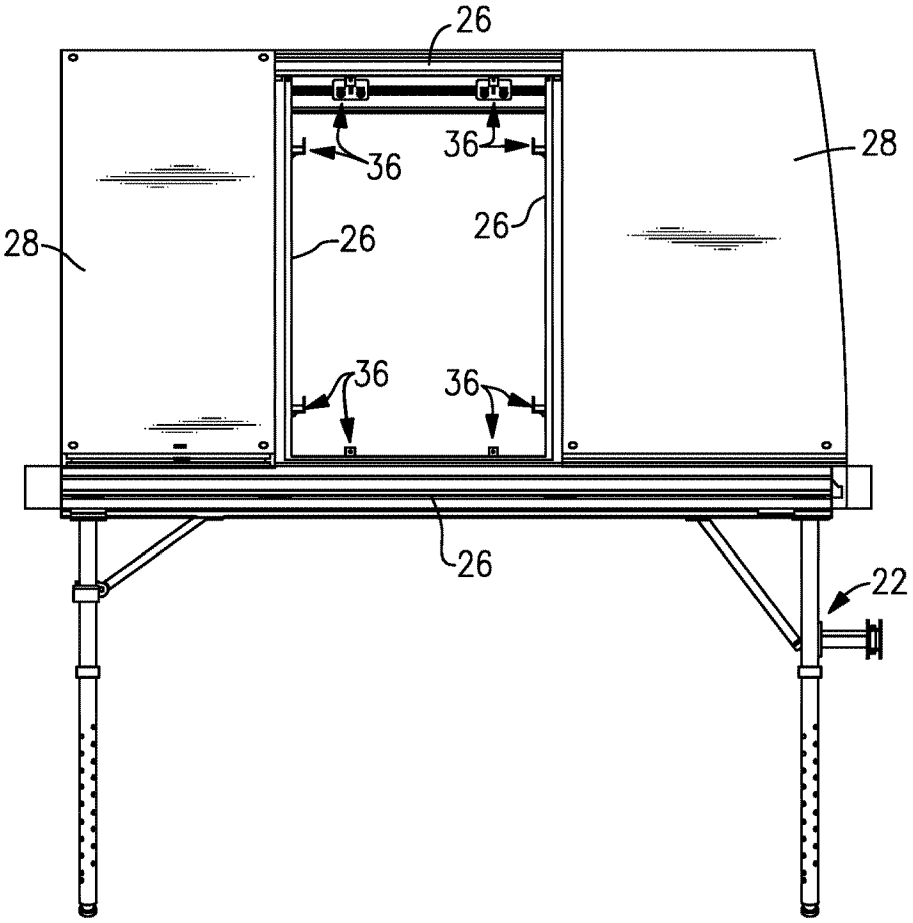
FIG. 8 is an example arrangement of the orchestra pit filler, including a plurality of bracket assemblies arranged relative to an opening.

The frame assembly 20 includes a plurality of beams 26 arranged to support either deck panels 28 or grid panels 30. As shown in FIG. 8, there is an arrangement of beams 26 defining an opening 78. Adjacent that opening 78, the beams 26 are configured to receive either a deck panel 28 or a grid panel 30. There are a plurality of bracket assemblies 36 provided about the opening. In this regard, each beam 26 may include one or more bracket assemblies 36. Each bracket assembly 36 is configured to support a portion of the outer frame 32.

Figure 9:
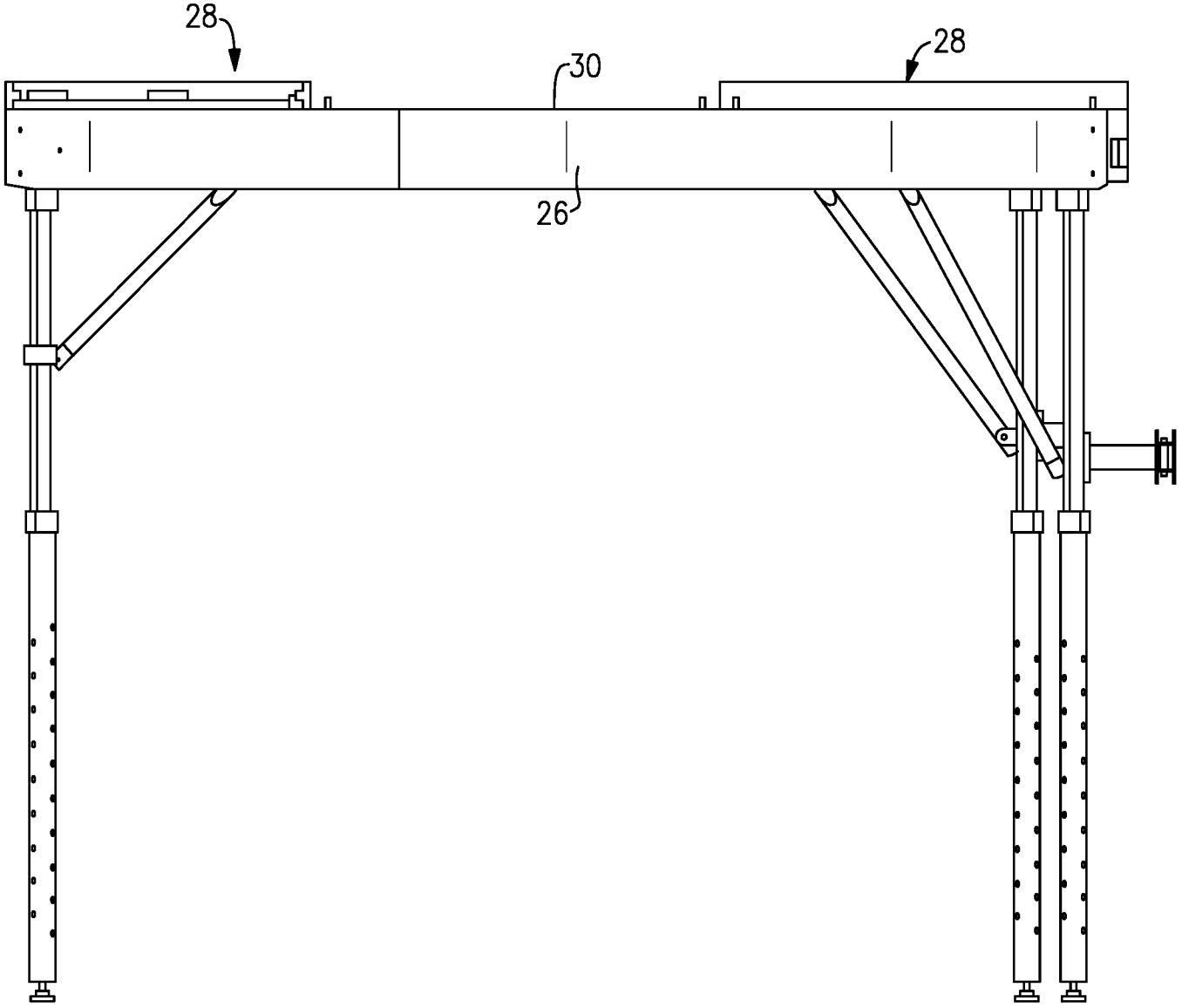
FIG. 9 is a view of the arrangement of FIG. 8 from a perspective of an audience member seated in the seating area of the theatre.

When the grid panel 30 is in place, by virtue of the above-described arrangement of the bracket assemblies 36, the grid panel 30 is not visible from a perspective of the audience in the seating area 14, as generally represented by FIG. 9. Thus, aesthetics of the orchestra pit filler 18 are improved.

Because of the arrangement of the bracket assembly 36, a deck panel 28 can be attached to the beam 26 such that the deck panel 28 vertically overlaps both the bracket assembly 36 and the grid panel 30, without requiring removal of either the grid panel 30 or the bracket assembly 36, as shown on the left-hand side of FIG. 5. Thus, this disclosure permits one to rapidly configure the orchestra pit filler 18 for different use cases.

It should be understood that terms such as "vertical," "lateral," "upward," and "downward" are used above with reference to the normal meaning with reference to the normal orientation of the structures described in the drawings. Terms such as "generally," "substantially," and "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A system for at least partially filling an orchestra pit or extending a stage, comprising:

a frame assembly connected to the stage, the frame assembly including a beam;

a deck panel connected to a first portion of the beam, the deck panel positioned adjacent to a front edge of the stage;

a grid panel; and a bracket assembly connected to a second portion of the beam and configured to support the grid panel, wherein the bracket assembly is configured to support the grid panel in a position in which a top of the grid panel is substantially vertically aligned with a top of the beam and is vertically spaced-apart beneath a top of the deck panel.

2. The system as recited in claim 1, wherein the bracket assembly is configured to support the grid panel in the position in which the top of the grid panel is vertically aligned with a bottom of the deck panel.

3. The system as recited in claim 1, wherein the deck panel vertically overlaps the bracket assembly, and the bracket assembly is configured such that neither the grid panel nor the bracket assembly interferes with a connection of the deck panel to the beam.

4. The system as recited in claim 1, wherein:

the grid panel includes an outer frame and a plurality of cables connected to the outer frame, and the bracket assembly includes an arm defining a slot configured to receive a portion of the outer frame.

5. The system as recited in claim 4, wherein the arm includes a horizontal section and a vertical section projecting vertically from an end of the horizontal section.

6. The system as recited in claim 5, wherein the horizontal section is substantially perpendicular to the vertical section.

7. The system as recited in claim 5, wherein a fastener assembly is configured to connect the outer frame to the vertical section.

8. The system as recited in claim 5, wherein:
the bracket assembly includes a plate, and
the horizontal section projects from the plate.

9. The system as recited in claim 8, wherein:
the arm includes a brace projecting from the plate, and
a top of the brace is connected to a bottom of the horizontal section.

10. The system as recited in claim 9, wherein the brace is substantially triangular in shape.

11. The system as recited in claim 8, wherein:
the beam includes a slotted channel, and
a fastener assembly connects the bracket assembly to the beam via the slotted channel.

12. The system as recited in claim 11, wherein:
a nut is arranged in the slotted channel, and
a bolt extending through the plate engages the nut to connect the bracket assembly to the beam.

13. The system as recited in claim 12, wherein the plate includes a locating tab projecting from the plate adjacent a top of the slotted channel.

14. The system as recited in claim 12, wherein:
the beam includes a capture channel open facing toward the slotted channel, and
an upper edge of the plate is received in the capture channel.

15. The system as recited in claim 14, wherein:
the beam includes a deck attachment channel arranged vertically above the capture channel,
the deck attachment channel includes a slot open facing a direction opposite the capture channel, and
a deck panel is connectable to the beam via the deck attachment channel using a fastener assembly.

16. A method of at least partially filling an orchestra pit or extending a stage, comprising:
providing the system of claim 1; and
supporting a grid panel using a bracket assembly connected to a beam such that the grid panel is held in a position in which a top of the grid panel is substantially aligned with a top of the beam and is vertically-spaced apart beneath a top of a deck panel.

17. The method as recited in claim 16, further comprising:
positioning the bracket assembly along a length of the beam by sliding the bracket assembly relative to a slotted channel of the beam.

18. The method as recited in claim 16, further comprising:
supporting a deck panel using the beam such the deck panel vertically overlaps the bracket assembly and such that neither the bracket assembly nor the grid panel interferes with a connection of the deck panel to the beam.

19. The method as recited in claim 16, further comprising:
supporting a deck panel using the beam, wherein the deck panel is supported by an opposite side of the beam as the grid panel, and wherein the bracket assembly supports the grid panel in a position in which a top of the grid panel is vertically spaced-apart beneath a top of the deck panel.

* * * * *